United States Patent [19]

Eichweber

[11] Patent Number: 4,527,483

[45] Date of Patent: Jul. 9, 1985

[54] SABOT PROJECTILE GUIDE

[75] Inventor: Kurt Eichweber, Hamburg, Fed. Rep. of Germany

[73] Assignee: Precitronic Gesellschaft für Feinmechanik und Electronic m.b.H., Hamburg, Fed. Rep. of Germany

[21] Appl. No.: 491,498

[22] Filed: May 4, 1983

[30] Foreign Application Priority Data

Dec. 9, 1982 [DE] Fed. Rep. of Germany ..... 3245540

[51] Int. Cl.[3] ..... F42B 13/16

[52] U.S. Cl. ..... 102/521

[58] Field of Search ..... 102/520–523, 102/529, 524–528, 532

[56] References Cited

U.S. PATENT DOCUMENTS

| | | | |
|---|---|---|---|
| 3,899,978 | 8/1975 | Luther et al. | 102/521 |
| 4,029,018 | 6/1977 | Bjornson | 102/521 |
| 4,239,006 | 12/1980 | Kelson | 102/522 |
| 4,284,008 | 8/1981 | Kirkendall et al. | 102/521 |
| 4,326,464 | 4/1982 | Price | 102/523 |

FOREIGN PATENT DOCUMENTS

| | | | |
|---|---|---|---|
| 72584 | 2/1983 | European Pat. Off. | 102/522 |
| 1703507 | 10/1972 | Fed. Rep. of Germany . | |
| 2844870 | 5/1980 | Fed. Rep. of Germany . | |

*Primary Examiner*—Harold J. Tudor

*Attorney, Agent, or Firm*—Townsend and Townsend

[57] ABSTRACT

A sabot projectile guide with a rear sabot intended for resting in a leak-proof manner against a smooth gun barrel, and with a front encircling guide collar intended for interacting with the barrel in a guiding manner, and with an encircling cavity enclosed essentially in a leak-proof manner between the sabot and the collar and the barrel. The tube friction, together with the tube damage arising from this, is reduced, centering of the projectile is improved and its scattering is reduced, because the periphery of the guide collar is designed as a dynamic gas bearing which has a ram zone open towards the front and a support gap connected to the cavity towards the rear. The cavity between sabot and the guide collar is closed off essentially in a leak-proof manner, apart from the gas bearing, so that during the interior ballistic phase a differential pressure sufficient for the functioning of the gas bearing is preserved between the ram side and the cavity.

4 Claims, 5 Drawing Figures

SABOT PROJECTILE GUIDE

BACKGROUND OF THE INVENTION

Arrowhead projectiles of small dimensions and large mass, which are fired from smooth-tube guns at a high initial velocity, achieve a high penetrating power which is advantageous especially in combat against armoured vehicles. So that, in spite of the small projectile cross-section, the predetermined weapon capacity in terms of interior ballistics can be converted into the kinetic energy of the projectiles, sabot projectile guides are used, and these guide the projectile centered during the interior ballistic phase and detach themselves from the projectile after it has left the tube. Their function is comparable to that of a piston. Known sabot projectile guides consist of light metal and/or plastic.

It has been found that sabot projectile guides of this type give rise to unexpectedly high wear in smooth-tube gun barrels. Also, the projectiles are scattered to a considerably greater extent than could have been expected in view of their good design, tolerance calculation and tube length. Typical cold-weld marks caused by light-metal parts, and vein-like flat furrows were observed on the inside wall of the tube, and these impair the firing accuracy especially when they are located in the last portion before the muzzle.

To minimise tilting movements of the projectile guide, which could be responsible for this damage, attempts were made to provide it with guide faces located axially as far apart as possible from one another. This results in a form of the sabot projectile guide with a rear sabot, the periphery of which is intended to rest in a leak-proof manner against the smooth gun barrel, and with a front guide collar interacting with the barrel in a guiding manner. Located between the sabot and the guide collar is an encircling cavity which is enclosed essentially in a leak-proof manner between these two parts and the barrel. The guide collar is recessed toward the front in the form of a bell; as a result, one the one hand, the peripheral face of this collar interacting with the barrel in a guiding manner is to be shifted as far forward as possible, and, on the other hand, it will become easier in aerodymanic terms to remove the multi-part projectile guide from the projectile after it has left the tube.

However, the invention has recognised that this design also has the disadvantage that the pressure, arising during firing, of the air column compressed in the barrel in front of the projectile expands the bellshaped guide collar and presses it against the barrel, and this can result in three-dimensional deformation, bending or vibrations. In severe cases, the application of pressure leads to cold-weld marks in the tube and consequently also to premature tube wear as a result of partial paring-out.

SUMMARY OF THE INVENTION

The object on which the invention is based is, therefore, to provide a sabot projectile guide which causes less tube wear whilst maintaining good guidance and aiming accuracy.

The solution according to the invention involves designing the periphery of the guide collar as a dynamic gas bearing which has a ram zone open towards the front and a support gap connected to the cavity towards the rear.

In other words, the idea of the invention lies in utilising the pressure difference between the air column compressed in the tube in front of the projectile and the cavity contained between the rear sabot and the front guide collar of the projectile guide for the purpose of a gas-bearing function in the region of the front guide collar of the projectile guide.

Aerodynamic gas bearings are known per se in connection with rotary mounting. The bearing elements are composed of a ram zone opening in the direction of movement and of a support gap adjoining it at the rear. The gas compressed in the ram zone as a result of the ram pressure generates in the region of the support gap a pressure which absorbs the bearing forces. The ram zone can be designed so as to narrow in a wedgeshaped manner, in such a way that the compression increases towards the support gap.

The ram zone is appropriately composed of a plurality of ram-zone pockets. In this way, wedge-shaped narrowing can be achieved not only between the barrel face and the limiting face, turned towards this, of the ram zone, but also as a result of wedge-shaped narrowing of the elevations separating the individual ram-zone pockets from one another. Moreover, the advantage of the division into ram-zone pockets is that pressure equalisation in the peripheral direction and consequently a tendency to vibration are counteracted. According to the invention, the ram-zone pockets form an encircling and conically narrowing rhomboid or gableroof pattern.

To ensure the efficiency of the gas bearing during the entire interior ballistic phase, the pressure in the cavity located behind the guide collar of the projectile guide must always be less than the ram pressure in front of the projectile. This can be achieved by giving the support gap suitable dimensions and by suitable calculation of the sealing quality of the sabot. Furthermore, it is advantageous, in this respect, if the parts forming the firing guide are connected to one another essentially in an air-tight manner.

According to a further feature of the invention, the guide disadvantages of the bell shape of the guide collar, which were explained above, are avoided because the latter has an encircling forward curvature on its front face. This forward curvature can be designed so that although the aerodynamic effect of removal of the projectile guide is preserved by means of a concave inner region of the guide collar, nevertheless, at the same time, there is formed on the outside a face on which the ram pressure can exert, within the tube, a force which is directed radially inwards and counteracts the force component originating from the concave part and directed outwards, and which thereby prevents the expansion of the guide collar. On its rear face, the guide collar can have a concave shape corresponding to the forward curvature, with the result that an enlargement of the cavity volume is obtained.

To prevent further the danger of cold-welding between the projectile guide and the barrel, the peripheral part of the guide collar forming the support gap can consist in a determining proportion of a heat-resistant plastic material, especially a polyfluorocarbon such as PTFE. The ram-zone region can also be made of such a material. Furthermore, making the ram-zone or support-gap region of plastic affords the advantageous possibility of designing this part of the guide collar as a sleeve which holds the multi-part projectile guide together until it leaves the tube and the strength of which is calculated so that it releases the projectile guide parts after they have left the tube. Release can take place as the result of tearing apart of the sleeve.

A gasket is advantageously provided on the periphery of the sabot, so as to achieve as high gas-tightness as possible between the powder chamber and the encircling cavity of the projectile guide. The gasket can consist of a plastic ring.

The projectile guide can also be made essentially of plastic in its entirety, and the necessary strength can be ensured, if appropriate, by means of reinforcements consisting of metal or other materials.

BRIEF DESCRIPTION OF THE DRAWING

The invention is explained in more detail below with reference to the drawing which illustrates advantageous exemplary embodiments and in which.

DETAILED DESCRIPTION OF THE PREFERRED EMBODIMENT

Figure 1:
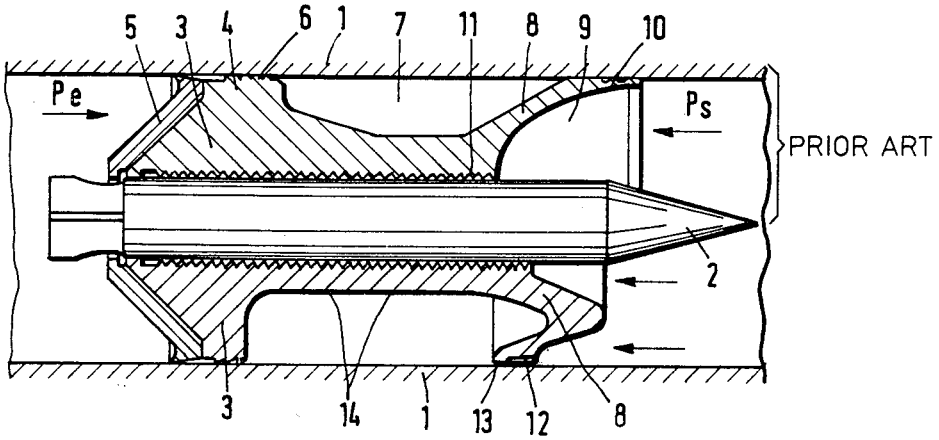
FIG. 1 shows a longitudinal section.

FIG. 1 shows, within the smooth barrel 1 of the gun tube, the projectile 2, the diameter of which is substantially less than that of the barrel and which is consequently guided in the projectile guide 3. The projectile designed, for example, as a hard-core projectile is to be accelerated in the tube to 1,500 meters per second and more, and should fly to the target without the projectile guide. Consequently, the projectile guide is made multipart in a known way (not shown in the drawing), so that the guide is removed from the projectile after it has left the tube.

The top half of FIG. 1 illustrates a design of the projectile guide which belongs to the state of the art and which generally consists of light metal. In the rear region it has a radial widened portion which forms together with the sleeve 5 the sabot and which performs guiding and sealing functions by means of its periphery 6 grooved in a peripheral direction. A cavity 7 serving to reduce the weight adjoins it towards the front. Located in the front region is the bell-shaped guide collar 8, on the periphery of which encircling grooves 10, guide rings made of plastic or the like can be provided. After it has left the tube, its bell-shaped recess 9 generates the aerodynamic forces to remove it from the projectile 2. The projectile guide is connected firmly to the projectile 2 by means of a toothing 11.

When this design is considered, it can easily be seen that the ram pressure Ps acting in front of the projectile can result in a widening of the guide collar 8, three-dimensional deformation, bending or possibly vibrations which can lead to high stresses on the friction interface region between the periphery of the guide collar 8 and the barrel.

In the design according to the invention, illustrated in the bottom half of FIG. 1, the bell-shaped formation of the guide collar 8 is avoided, and instead of this a cross-sectional design curved forwards in the manner of a bead is selected. As a result, the ram pressure can no longer press the guide collar against the inside wall of the tube, but the forces acting radially outwards and radially inwards on the front face of the collar 8 neutralise each other. There is a slight internal inward guide in the form of a concentric, V-shaped, bead-like design. The dimensions of the inner concavely conical region of the front face of the guide collar and those of the outer oppositely conical part can easily be co-ordinated with one another so that, on the one hand, the above-mentioned neutralisation of the radial forces takes place and, on the other hand, the aerodynamic forces necessary for removing the projectile guide from the projectile are nevertheless generated.

On the rear face of the guide collar, the cross-sectional contour is repeated for the purpose of enlarging the cavity 7.

Located on the periphery of the guide collar 8 is a pattern 12, 13 of a linear ram-zone air bearing which is composed of a front ram zone 12 narrowing in a wedge-shaped manner towards the rear and of a support gap 13 adjoining it at the rear. The air compressed in front of the projectile when the projectile is fired is further compressed in the converging ram zone 12 and flow through the support gap 13, generating a considerable excess pressure at this point, into the cavity 7. At the same time, the pressure in the cavity 7 gradually increases. This increasing excess pressure benefits the projectile guide inasmuch as now a pressure, increasing up to the muzzle, that is to say until the tube is left, of the shell-like parts of the projectile guide against the projectile is applied in the region 14, and this contributes to the centering of the projectile. Because of the effect described, the ram-zone bearing results in contact-free guidance and centering of the moving parts in the tube.

Figure 2:
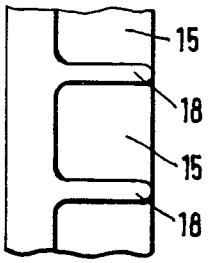
FIGS. 2, 3 and 4 show a radial view of the peripheral face of the guide collar.
Figure 3:
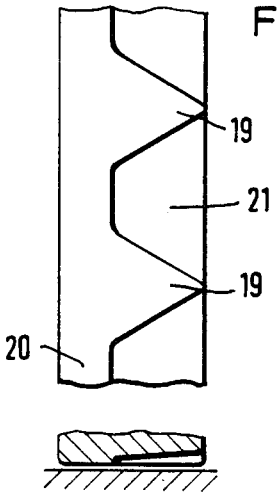
Figure 4:
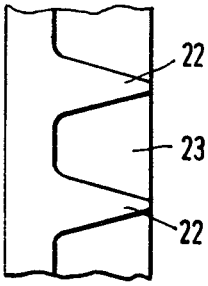
Figure 5:
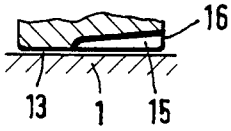
FIG. 5 shows a partial longitudinal section through the peripheral region of the guide collar.

Examples of ram-zone patterns are illustrated in FIGS. 2, 3 and 4. In the example of FIG. 2, the ram zone 12 is divided into pockets 15 by axial ribs 18. In these pockets, which according to FIG. 5 approach the inner face 1 of the tube to the rear in a wedge-shaped manner, some of the air which arises is additionally compressed as a result of the opening ratio in relation to the width of the support gap 13. There arises in the region of the support gap the supporting high-pressure air film which centres the element as a whole and which is then transferred into the cavity 7. The separation of the individual ram-zone pockets 15 by means of the webs 18 ensures uniform formation of the support film and thereby counteracts vibrations.

In the example according to FIG. 3, the web faces 19 are enlarged substantially and limited obliquely at the sides in such a way that the cross-section of the ram-zone pockets 21 is also greatly reduced along their path in the direction of flow. The dimension of the face 20 forming the support gap is enlarged in the direction of flow. The triangular shape of the web faces 19 leads, in the region of the ram zone, to higher compression and consequently to a further improvement in the supporting gas film, with a lower consumption of gas. The gas consumption arises from the pressure and the width of the support gap as well as from the absorbing capacity of the cavity 7.

The pattern according to FIG. 4 is similar to that of FIG. 3, but is made somewhat finer, since the web patterns 22 are somewhat narrower, and therefore there is an increased number of ram-zone pockets 23 over the periphery, resulting in an even more careful centering during the first 10–20% of the distance covered in the tube.

It is obvious that further alternative forms of the patterns illustrated are also possible.

The peripheral region 12, 13 of the guide collar 8 can be made of a suitable sufficiently temperature-resistant material favourable in terms of friction, for example of a suitable plastic which is prefabricated as a sleeve in the form of a strip and which is wrapped round the parts forming the projectile guide.

As perfect a seal as possible is sought on the periphery of the sabot 3, and this can easily be effected by appropriate constructional means, for example a lip-shaped design of the sleeve 5.

Not only is the tube wear reduced as a result of the guide design according to the invention, but centering and consequently firing accuracy are also improved.

The cavity 7 is preferably longer than a calibre.

I claim:

1. A sabot for guiding a projectile within a gun barrel comprising:

a sabot body encircling the projectile and including a rear barrel engaging portion and a front barrel engaging portion defining a cavity therebetween;

said front portion having a forward face including inner and outer surfaces, said inner surface extending axially forwardly and radially outwardly and said outer surface extending axially rearwardly and radially outwardly so fluid pressures on said inner and outer surfaces oppose one another while the sabot guided projectile passes through the gun barrel; and said front portion including a peripheral gas bearing surface following said outer surface and facing the gun barrel so said front region is guided through the gun barrel by a gas bearing created between said gas bearing surface and the gun barrel, said gas bearing surface including an outer support gap surface and a plurality of forwardly opening ram zone pockets and fluidly coupling said cavity with a region forward of said forward face outer surface, said ram zone having a trapezoidal cross-sectional shape when taken along a radial plane.

2. A sabot for guiding a projectile within a gun barrel comprising:

a sabot body encircling the projectile and including a rear barrel engaging portion and a front barrel engaging portion defining a cavity therebetween;

said front portion having a forward face including inner and outer surfaces, said inner surface extending axially forwardly and radially outwardly and said outer surface extending axially rearwardly and radially outwardly so fluid pressures on said inner and outer surfaces oppose one another while the sabot guided projectile passes through the gun barrel;

said front portion including a peripheral gas bearing surface following said outer surface and facing the gun barrel so said front region is guided through the gun barrel by a gas bearing created between said gas bearing surface and the gun barrel;

said gas bearing surface including an outer support gap surface and a forwardly opening ram zone portion; and said ram zone portion comprising a plurality of ram zone pockets.

3. The sabot of claim 2 wherein said ram zone pockets narrow in their rotary dimensions from front to rear.

4. The sabot of claim 3 wherein said ram zone pockets have a trapezoidal cross-sectional shape when taken along a radial plane.

* * * * *